US008004174B2

(12) United States Patent
Jo

(10) Patent No.: US 8,004,174 B2
(45) Date of Patent: Aug. 23, 2011

(54) LIGHT-EMITTING DEVICE AND ELECTRONIC APPARATUS

(75) Inventor: Hiroaki Jo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 12/266,898

(22) Filed: Nov. 7, 2008

(65) Prior Publication Data

US 2009/0140631 A1 Jun. 4, 2009

(30) Foreign Application Priority Data

Nov. 30, 2007 (JP) ..... 2007-310003

(51) Int. Cl.
*H05B 33/14* (2006.01)

(52) U.S. Cl. ..... 313/500; 313/498

(58) Field of Classification Search ..... 257/40, 257/72, 98–100, 642–643, 759; 313/498–512; 315/169.1, 169.3; 427/58, 64, 66, 532–535, 427/539; 428/690–691, 917; 438/26–29, 438/34, 82; 445/24–25
See application file for complete search history.

(56) References Cited

U.S. PATENT DOCUMENTS 7,439,667 B2 * 10/2008 Ohtani ..... 313/500
2005/0127819 A1 * 6/2005 Ohtani ..... 313/500

FOREIGN PATENT DOCUMENTS

JP A-08-108568 4/1996

* cited by examiner

*Primary Examiner* — Nimeshkumar D Patel
*Assistant Examiner* — Donald L Raleigh
(74) *Attorney, Agent, or Firm* — Oliff & Berridge, PLC

(57) ABSTRACT

A light-emitting device includes four or more rows of element groups each having light-emitting elements arranged in a first direction, the element groups being arranged in parallel in a second direction different from the first direction. In each of a plurality of unit regions arranged in the first direction, the light-emitting elements belonging to the four or more rows of element groups are arranged at different positions by ones. The four or more rows of element groups includes a first element group, a second element group, and a third element group adjacent to the second element group. In each of the plurality of unit regions, the light-emitting element belonging to the second element group is disposed on one side in the first direction when viewed from the light-emitting element belonging to the first element group, and the light-emitting element belonging to the third element group is disposed on the other side in the first direction when viewed from the light-emitting element belonging to the first element group.

11 Claims, 9 Drawing Sheets

LIGHT-EMITTING DEVICE AND ELECTRONIC APPARATUS

BACKGROUND

1. Technical Field

The present invention relates to arrangement of various light-emitting elements, such as organic light-emitting diodes (hereinafter, referred to as "OLEDs").

2. Related Art

A light-emitting device having a plurality of light-emitting elements arranged on a substrate is used, for example, as an exposure device (optical head) for exposing an image bearing member in an electrophotographic image forming apparatus. JP-A-8-108568 discloses a light-emitting device that has a plurality of light-emitting elements arranged in two rows in a zigzag manner. That is, two rows of element groups each having a plurality of light-emitting elements arranged in a main scanning direction are arranged to be spaced at an interval in a sub-scanning direction. The light-emitting elements in the element group of the first row and the light-emitting elements in the element group of the second row are provided at different positions in the main scanning direction.

To achieve high-definition for an image (latent image) to be formed on the image bearing member by the light-emitting device, the number of rows of element groups may be increased. However, the increase in the number of rows of element groups leads to an increase in the dimension of a region in the sub-scanning direction (hereinafter, referred to as "element forming region" where each light-emitting element is to be formed. The increase in the dimension of the element forming region in the sub-scanning direction results in deterioration of image formation performance of the image bearing member or an increase in the size of the light-emitting device.

SUMMARY

An advantage of some aspects of the invention is that it provides arrangement of four or more rows of element groups within a narrow range.

According to an aspect of the invention, a light-emitting device includes four or more rows of element groups each having a plurality of light-emitting elements arranged in a first direction, the element groups being arranged in parallel in a second direction different from the first direction. In each of a plurality of unit regions arranged in the first direction, the light-emitting elements belonging to the four or more rows of element groups are individually arranged at different positions. The four or more rows of element groups include a first element group (for example, including element groups $G_2$ and $G_3$ shown in FIG. 2, an element group $G_4$ shown in FIG. 8, and element groups $G_2$, $G_4$, and $G_5$ shown in FIG. 9), a second element group, and a third element group adjacent to the second element group. In each of the plurality of unit regions, the light-emitting element belonging to the second element group is disposed on one side in the first direction when viewed from the light-emitting element belonging to the first element group, and the light-emitting element belonging to the third element group is disposed on the other side in the first direction when viewed from the light-emitting element belonging to the first element group.

With this configuration, the light-emitting element belonging to the second element group and the light-emitting element belonging to the third element group are spaced from each other in the first direction with the light-emitting element belonging to the first element group. Therefore, it is possible to shorten a distance in the second direction between the light-emitting element belonging to the second element group and the light-emitting element belonging to the third element group, as compared with a case in which the light-emitting element belonging to the second element group and the light-emitting element belonging to the third element group are close to each other in the first direction. As a result, it is possible to reduce the dimension of an element forming region in the second direction.

The light-emitting elements may be individually disposed on lines that are arranged in parallel at regular intervals along the first direction and extend in the second direction. With this configuration, when the light-emitting device is used as an exposure device for an image forming apparatus, it is possible to make the intervals between the pixels arranged along the first direction from an image formed on an image bearing member be the same.

In the light-emitting device according to the aspect of the invention, the four or more rows of element groups may include four rows of element groups. The light-emitting elements belonging to an element group of a first row may be individually disposed on (4*k*+1)th lines (where k=0, 1, . . . , and n), the light-emitting elements belonging to an element group of a second row may be individually disposed on (4*k*+3)th lines, the light-emitting elements belonging to an element group of a third row may be individually disposed on (4*k*+2)th lines, and the light-emitting elements belonging to an element group of a fourth row may be individually disposed on (4*k*+4)th lines. According to this configuration, in each of the plurality of unit regions, a distance in the second direction between the light-emitting element belonging to the element group of the first row and the light-emitting element belonging to the element group of the second row, and a distance in the second direction between the light-emitting element belonging to the element group of the third row and the light-emitting element belonging to the element group of the fourth row can be shorter than a distance in the second direction between the light-emitting element belonging to the element group of the second row and the light-emitting element belonging to the element group of the third row.

In the light-emitting device according to the aspect of the invention, the four or more rows of element groups may include four rows of element groups. The light-emitting elements belonging to an element group of a first row may be individually disposed on (4*k*+1)th lines (where k=0, 1, . . . , and n), the light-emitting elements belonging to an element group of a second row may be individually disposed on (4*k*+2)th lines, the light-emitting elements belonging to an element group of a third row may be individually disposed on (4*k*+4)th lines, and the light-emitting elements belonging to an element group of a fourth group may be individually disposed on (4*k*+3)th lines. With this configuration, in each of the plurality of unit regions, a distance in the second direction between the light-emitting element belonging to the element group of the second row and the light-emitting element belonging to the element group of the third row can be shorter than a distance, and a distance in the second direction between the light-emitting element belonging to the element group of the first row and the light-emitting element belonging to the element group of the second row, and a distance in the second direction between the light-emitting element belonging to the element group of the third row and the light-emitting element belonging to the element group of the fourth row.

In the light-emitting device according to the aspect of the invention, the four or more rows of element groups may include five rows of element groups. The light-emitting elements belonging to an element group of a first row may be individually disposed on (4*k*+1)th lines (where k=0, 1, . . . , and n), the light-emitting elements belonging to an element group of a second row may be individually disposed on (4*k*+3)th lines, the light-emitting elements belonging to an element group of a third row may be individually disposed on (4*k*+5)th lines, the light-emitting elements belonging to an element group of a fourth row may be individually disposed on (4*k*+2)th lines, and the light-emitting elements belonging to an element group of a fifth row may be individually disposed on (4*k*+4)th lines. With this configuration, in respect to all combinations of adjacent element groups in the second direction, it is possible to reduce a distance in the second direction between the light-emitting elements, as compared with a case in which in respect to all combinations of adjacent element groups in the second direction, a distance in the first direction between the light-emitting elements is constant.

According to another aspect of the invention, a light-emitting device includes a plurality of light-emitting elements that are arranged with respect to a first direction and a second direction intersecting the first direction. The plurality of light-emitting elements are formed by a plurality of element groups provided with respect to the second direction. Each of the plurality of element groups includes a first light-emitting element, a second light-emitting element, a third light-emitting element, and a fourth light-emitting element. With respect to the second direction, the second light-emitting element is disposed between the first light-emitting element and the third light-emitting element, and with respect to the first direction, the third light-emitting element is disposed between the first light-emitting element and the second light-emitting element.

In the light-emitting device according to the aspect of the invention, with respect to the second direction, the first light-emitting element, the second light-emitting element, the third light-emitting element, and the fourth light-emitting element may be arranged in that order. With respect to the first direction, the first light-emitting element, the third light-emitting element, the second light-emitting element, and the fourth light-emitting element may be arranged in that order.

In the light-emitting device according to the aspect of the invention, each of the plurality of element groups may further include a fifth light-emitting element. With respect to the second direction, the first light-emitting element, the second light-emitting element, the third light-emitting element, the fourth light-emitting element, and the fifth light-emitting element may be arranged in that order. With respect to the first direction, the first light-emitting element, the third light-emitting element, the fifth light-emitting element, the second light-emitting element, and the fourth light-emitting element may be arranged in that order.

According to yet another embodiment of the invention, an electronic apparatus includes the above-described light-emitting device. The light-emitting device is used in various electronic apparatuses. As an example of the electronic apparatus according to another aspect of the invention, an electrophotographic image forming apparatus that uses the light-emitting device to expose an image bearing member, such as a photosensitive drum may be exemplified. The image forming apparatus includes an image bearing member on which an electrostatic latent image is formed by exposure, the light-emitting device that exposes the image bearing member, and a developer that deposits a developing agent (for example, toner) onto the electrostatic latent image on the image bearing member to form a toner image.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
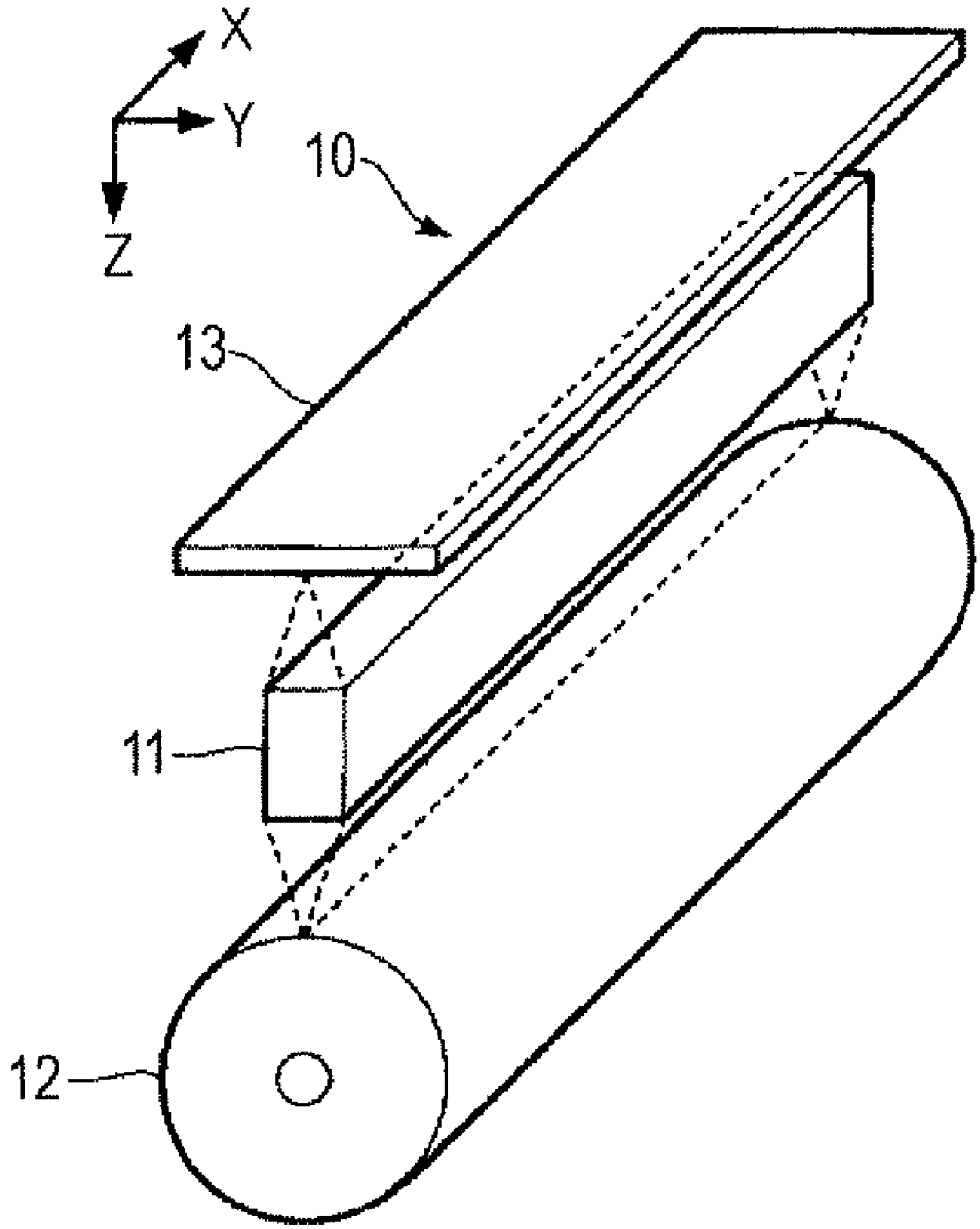
FIG. 1 is a perspective view showing the partial configuration of an image forming apparatus according to a first embodiment of the invention.

FIG. 1 is a perspective view showing the partial configuration of an image forming apparatus that uses a light-emitting device according to a first embodiment of the invention as an exposure device (optical head). As shown in FIG. 1, the image forming apparatus includes a light-emitting device 10, a light-collecting lens array 11, and a photosensitive drum (image bearing member) 12. The light-emitting device 10 includes a plurality of light-emitting elements (not shown in FIG. 1) linearly arranged on a surface of a substrate 13. The light-emitting elements selectively emit light in accordance with the features of images to be printed on a recording medium, such as a sheet. The photosensitive drum 12 is supported by a rotation shaft extending in an X direction (a main scanning direction), and rotates in a Y direction (a sub-scanning direction in which a recording medium is transported) with its outer peripheral surface opposed to the light-emitting device 10.

The light-collecting lens array 11 is disposed in a space between the light-emitting device 10 and the photosensitive drum 12. The light-collecting lens array 11 includes a plurality of gradient index lenses arranged in the form of an array with the optical axis of each gradient index lens directed to the light-emitting device 10. As the light-collecting lens array 11, for example, an SLA (Selfoc Lens Array) commercially available from Nippon Sheet Glass Co., Ltd. may be used (SELFOC is Registered Trademark of Nippon Sheet Glass Co., Ltd.).

Light emitted from each of the light-emitting elements of the light-emitting device 10 passes through a corresponding one of the gradient index lenses of the light-collecting lens array 11 and reaches the surface of the photosensitive drum 12. This exposure causes a latent image (electrostatic latent image) to be formed on the surface of the photosensitive drum 12 in accordance with a desired image.

Figure 2:
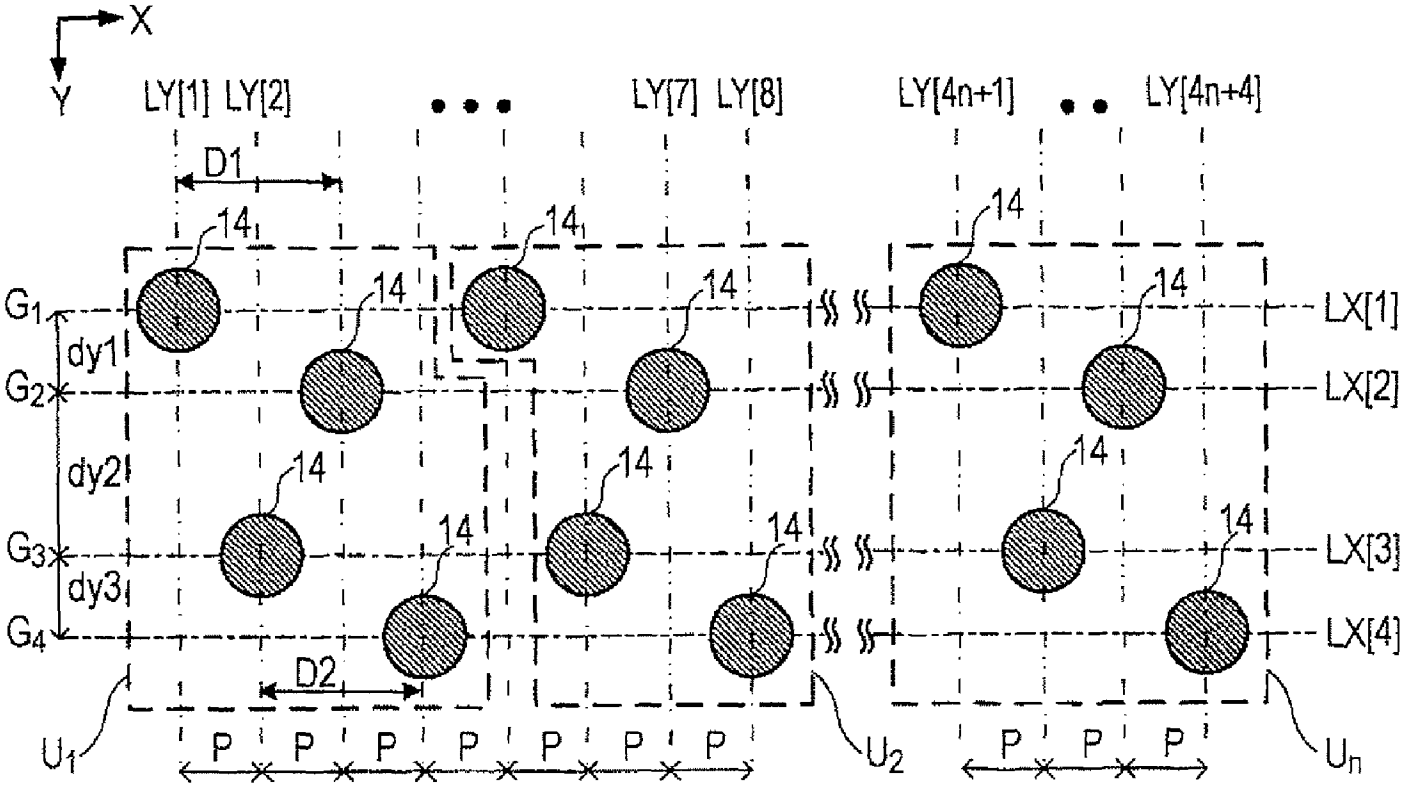
FIG. 2 is a plan view of a light-emitting device according to the first embodiment of the invention.

FIG. 2 is a plan view of the light-emitting device 10. Four rows of element groups G ($G_1$ to $G_4$) are arranged on the surface of the substrate 13 in parallel in the Y direction. Each of the element groups G ($G_1$ to $G_4$) includes n light-emitting elements 14 arranged in the X direction. If n unit regions U ($U_1$ to $U_n$) are defined on the substrate 13 to be arranged in the X direction, in each unit region U, four light-emitting elements 14 belonging to different element groups G are individually arranged at different positions in the X direction.

As shown in FIG. 2, it is supposed that four lines LX (LX[1], LX[2], LX[3], and LX[4]) are arranged on the substrate 13 in parallel to be spaced at intervals in the Y direction and to extend in the X direction. The n light-emitting elements 14 belonging to an element group Gj of a j-th (where j=1 to 4) row are arranged in the X direction such that the center of each of the light-emitting elements 14 is disposed on a corresponding line LX[j].

It is supposed that a plurality of lines LY (LY[1], LY[2], . . . , LY[4*n*+1], . . . , and LY[4*n*+4]) are arranged on the substrate 13 in parallel to be spaced at predetermined intervals P in the X direction and to extend in the Y direction. Each of the light-emitting elements 14 belonging to each of the element groups G ($G_1$ to $G_4$) is disposed on a corresponding line LY[i]. The center of each of the light-emitting elements 14 is disposed on a corresponding line LY[i]. That is, the light-emitting elements 14 of each of the element groups G ($G_1$ to $G_4$) are arranged such that a distance in the X direction between adjacent light-emitting elements 14 in the X direction has a common dimension P.

As shown in FIG. 2, the n light-emitting elements 14 belonging to the element group $G_1$ of the first row are individually disposed on (4*k*+1)th lines LY[4*k*+1] (where k=0, 1, 2, . . . , and n) when viewed from the negative X direction (a left side in FIG. 2). The n light-emitting elements 14 belonging to the element group $G_2$ of the second row are individually disposed on (4*k*+3)th lines LY[4*k*+3]. The n light-emitting elements 14 belonging to the element group $G_3$ of the third row are individually disposed on (4*k*+2)th lines LY[4*k*+2]. The n light-emitting elements 14 belonging to the element group $G_4$ of the fourth row are individually disposed on (4*k*+4)th lines LY[4*k*+4].

That is, each of the light-emitting elements 14 belonging to the element group $G_3$ is disposed within an interval between the line LY[4*k*+1] on which the center of each of the light-emitting elements 14 belonging to the element group $G_1$ is disposed and the line LY[4*k*+3] on which the center of each of the light-emitting elements 14 belonging to the element group $G_2$ is disposed. Bach of the light-emitting elements 14 belonging to the element group $G_2$ is disposed within a space between the line LY[4*k*+2] on which the center of each of the light-emitting elements 14 belonging to the element group $G_3$ is disposed and the line LY[4*k*+4] on which the center of each of the light-emitting elements 14 belonging to the element group $G_4$ is disposed Therefore, focusing on adjacent element groups $G_1$ and $G_2$ in the Y direction, as shown in FIG. 2, a center-to-center distance D1 in the X direction between each of the light-emitting elements 14 belonging to the element group $G_1$ and a corresponding one of the light-emitting elements 14 belonging to the element group $G_2$ becomes a distance 2P (for two columns), which is larger than the interval P between the lines LY. Similarly, focusing on adjacent element groups $G_3$ and $G_4$ in the Y direction, as shown in FIG. 2, a center-to-center distance D2 in the X direction between each of the light-emitting elements 14 belonging to the element group $G_3$ and a corresponding one of the light-emitting elements 14 belonging to the element group $G_4$ becomes a distance 2P (for two columns), which is larger than the interval P between the lines LY.

Figure 3:
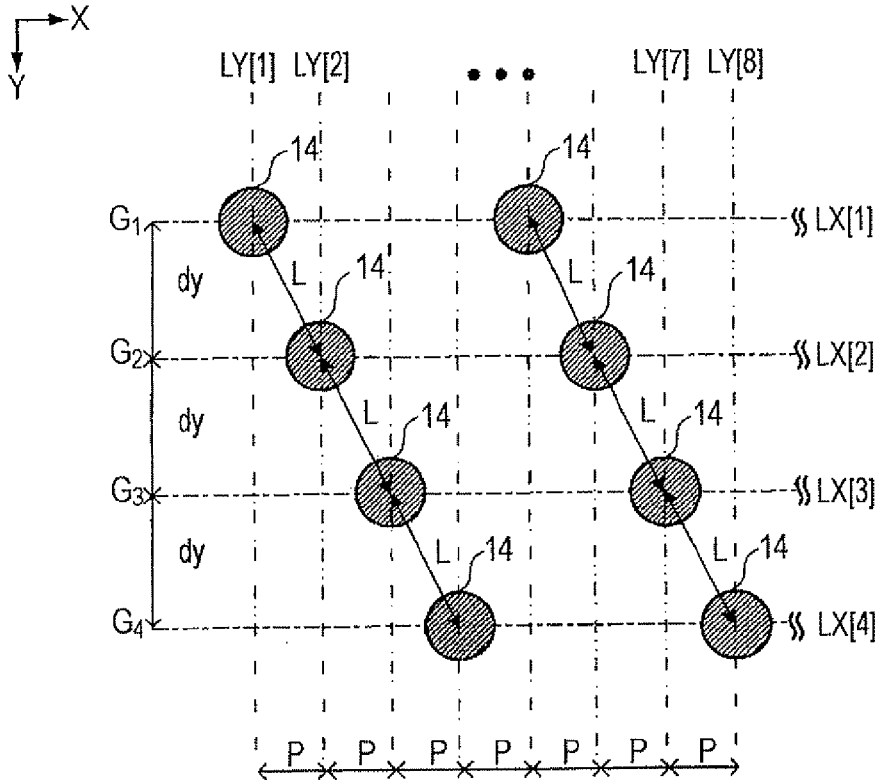
FIG. 3 is a plan view of a light-emitting device according to a comparative example.

As shown in FIG. 3, as a comparative example of this embodiment, it is supposed that the light-emitting elements 14 of the element groups $G_1$ to $G_4$ are arranged such that a distance in the X direction between the light-emitting elements 14 belonging to adjacent element groups in the Y direction becomes the dimension P. In the comparative example, each of n light-emitting elements 14 belonging to the element group $G_1$ is disposed on a corresponding line LY[4*k*+1], and each of n light-emitting elements 14 belonging to the element group $G_2$ is disposed on a corresponding line LY[4*k*+2]. Each of n light-emitting elements 14 belonging to the element group $G_3$ is disposed on a corresponding line LY[4*k*+3], and each of n light-emitting elements 14 belonging to the element group $G_4$ is disposed on a corresponding line LY[4*k*+4].

In order to form the light-emitting elements 14 to be electrically or structurally separated from each other and to ensure a space for a circuit driving the respective light-emitting elements 14 or wiring, it is necessary to set the light-emitting elements 14 to be spaced at a predetermined distance. If it is supposed that it is necessary to set the centers of adjacent light-emitting elements 14 to be at least spaced at a distance L, in the comparative example of FIG. 3, in order to ensure the interval L between adjacent light-emitting elements 14 with the interval P set in the X direction, it is necessary to set a distance dy in the Y direction between the light-emitting elements 14 to be larger than $\sqrt{(L^2-P^2)}$.

According to the comparative example, in respect to all combinations of adjacent element groups G in the Y direction, the distance in the X direction between the light-emitting elements 14 is P. Therefore, it is necessary to set the sum of an interval dy between the line LX[1] (the element group $G_1$) and the line LX[2] (the element group $G_2$), an interval dy between the line LX[2] (the element group $G_2$) and the line LX[3] (the element group $G_3$), and an interval dy in the Y direction between the line LX[3] (the element group $G_3$) and the line LX[4] (the element group $G_4$) to be larger than $\sqrt{(L^2-P^2)}$.

In order to achieve high-definition images, it is necessary to reduce the interval P in the X direction between the light-emitting elements 14. With the configuration of the comparative example, as the interval P is reduced, it is necessary to increase the distance dy. For this reason, an increase in dimension to be ensured in the Y direction for arrangement of the light-emitting elements 14 becomes obvious with high-definition images. In addition, when each of the light-emitting elements 14 is reduced in area in order to reduce the current density of each of the light-emitting elements 14, similarly, it is necessary to increase the distance dy. This causes an increase in dimension to be ensured in the Y direction for arrangement of the light-emitting elements 14.

In contrast, in this embodiment, the distance D1 in the X direction between each of the light-emitting elements 14 belonging to the element group $G_1$ of the first row and a corresponding one of the light-emitting elements 14 belonging to the element group $G_2$ of the second row, and the distance D2 in the X direction between each of the light-emitting elements 14 belonging to the element group $G_3$ of the third row and a corresponding one of the light-emitting elements 14 belonging to the element group $G_4$ of the fourth row are set to a dimension (2P) larger than the interval P between the lines LY. Therefore, in order to ensure the interval L between the center of each of the light-emitting elements 14 belonging to the element group $G_1$ of the first row and the center of a corresponding one of the light-emitting elements 14 belonging to the element group $G_2$ of the second row, and between the center of each of the light-emitting elements 14 belonging to the element group $G_3$ of the third row and the center of a corresponding one of the light-emitting elements 14 belonging to the element group $G_4$ of the fourth row, what is necessary is that a distance dy1 between the line LX[1] (the element group $G_1$) and the line LX[2] (the element group $G_2$), and a distance dy3 between the line LX[3] (the element group $G_3$) and the line LX[4] (the element group $G_4$) are set to be larger than $\sqrt{(L^2-4P^2)}$. That is, the region where the light-emitting elements 14 are to be formed can be reduced in dimension in the Y direction, as compared with the comparative example. Moreover, the center-to-center distance between each of the light-emitting elements 14 of the second row and a corresponding one of the light-emitting elements 14 of the third element group $G_3$ is the same the interval P between the lines LY. A distance dy2 of FIG. 2 is the same as the distance dy in the comparative example of FIG. 3.

As described above, according to the configuration of this embodiment, it is possible to suppress an increase in dimension of the element forming region (a region where each light-emitting element 14 is to be formed) in the Y direction. In addition, as described above, an increase in dimension of the element forming region in the Y direction becomes problematic due to high-definition or an increase in area of the light-emitting elements 14 in the Y direction. Therefore, this embodiment is effective in achieving high definition or increasing the area of the light-emitting elements 14.

The further away from the central axis of the light-collecting lens array 11 a position is, the more the optical characteristic (light-collecting performance) of the light-collecting lens array 11 is deteriorated. Accordingly, in the comparative example, a light-emitting element 14 disposed at an end of the element forming region in the Y direction is significantly away from the central axis of the light-collecting lens array 11. For this reason, light emitted from the light-emitting element 14 may not be sufficiently collected on the photosensitive drum 12. In contrast, in this embodiment, the dimension of the element forming region in the Y direction is reduced (that is, a distance between each light-emitting element and the central axis of the light-collecting lens array 11 is shortened). Accordingly, light emitted from all of the light-emitting elements 14 is sufficiently collected on the surface of the photosensitive drum 12. Therefore, it is possible to form high-definition images, as compared with the comparative example. In addition, the dimension of the element forming region in the Y direction is reduced, and as a result, it is possible to reduce the dimension of each of the light-emitting elements 14 (substrate) in the Y direction.

According to the configuration shown in FIG. 2, the center-to-center distance dy (dy1 to dy3) in the Y direction between the light-emitting elements 14 of adjacent element groups G in the Y direction is set to an integer multiple of the interval P between the lines LY such that an image (latent image) having pixels arranged in a lattice is formed on the surface of the photosensitive drum 12. Specifically, the distance dy1 between the line LX[1] (the element group $G_1$) and the line LX[2] (the element group $G_2$), and the distance dy3 between the line LX[3] (the element group $G_3$) and the line LX[4] (the element group $G_4$) are set to the dimension P. The distance dy2 between the line LX[2] (the element group $G_2$) and the line LX[3] (the element group $G_3$) is set to be two times (2P) larger than the dimension P.

The light-emission operation of the light-emitting device 10 will be described with reference to FIGS. 4 to 7. The photosensitive drum 12 rotates (progresses) in a direction indicated by an arrow of FIG. 4, and each time the photosensitive drum 12 moves in the Y direction by 1 dot, the light-emitting elements 14 in the element groups G ($G_1$ to $G_4$) repeatedly emit light together.

Figure 4:
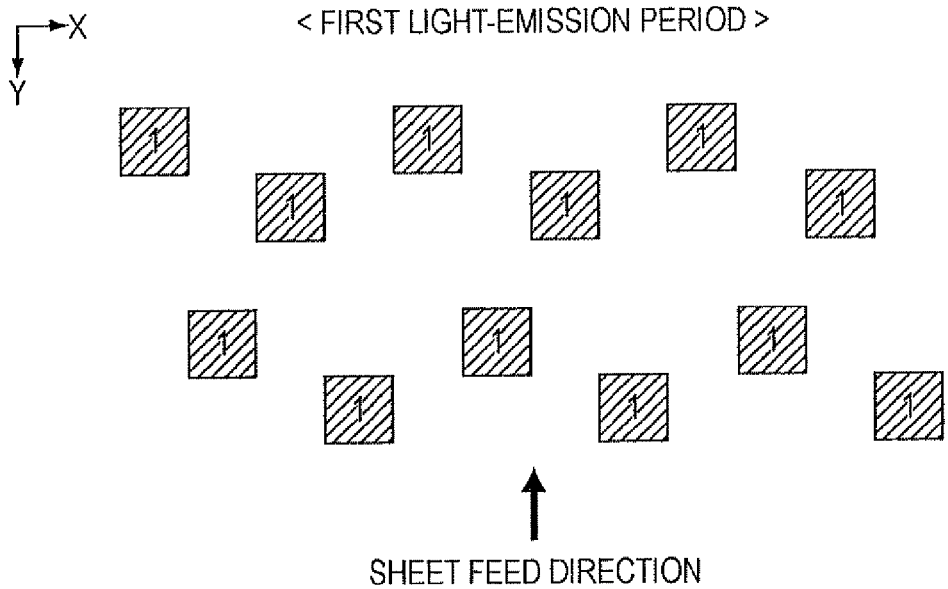
FIG. 4 is a conceptual view illustrating exposure by the light-emitting device according to the first embodiment of the invention.
Figure 5:
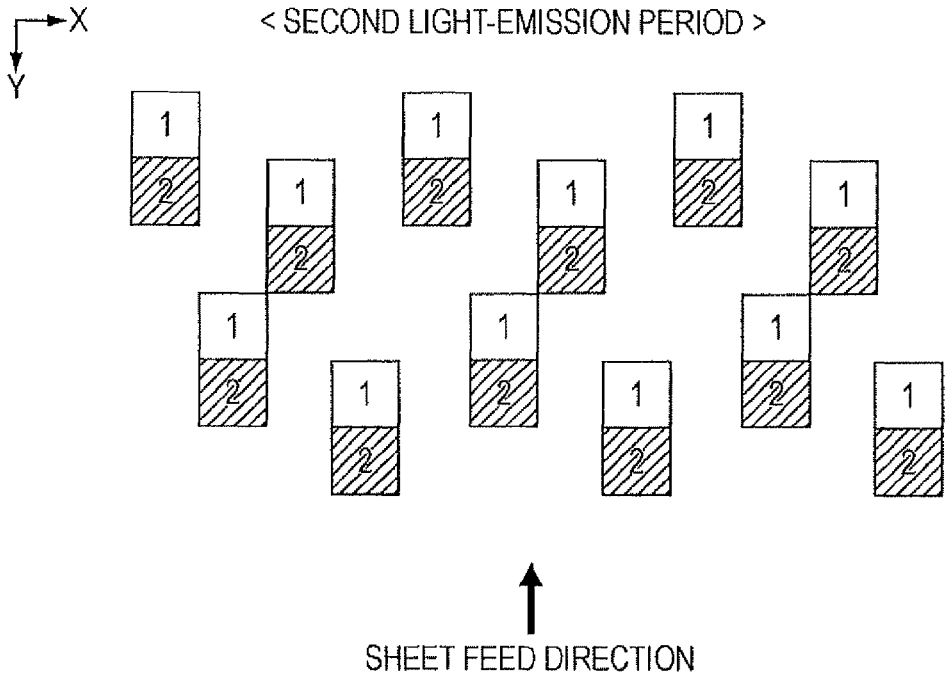
FIG. 5 is a conceptual view illustrating exposure by the light-emitting device according to the first embodiment of the invention.
Figure 6:
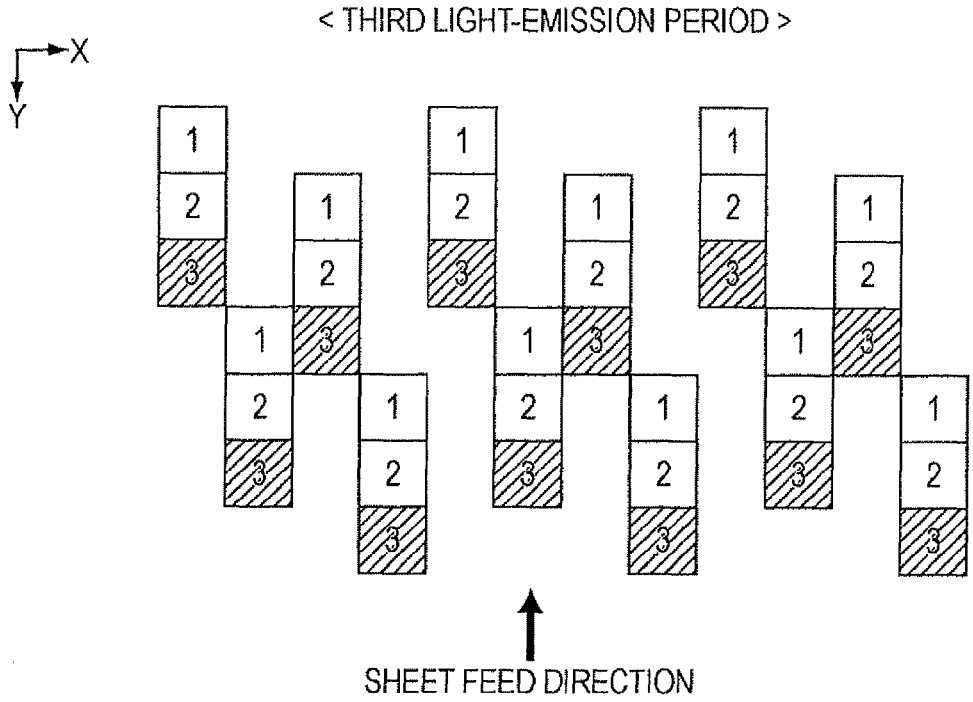
FIG. 6 is a conceptual view illustrating exposure by the light-emitting device according to the first embodiment of the invention.
Figure 7:
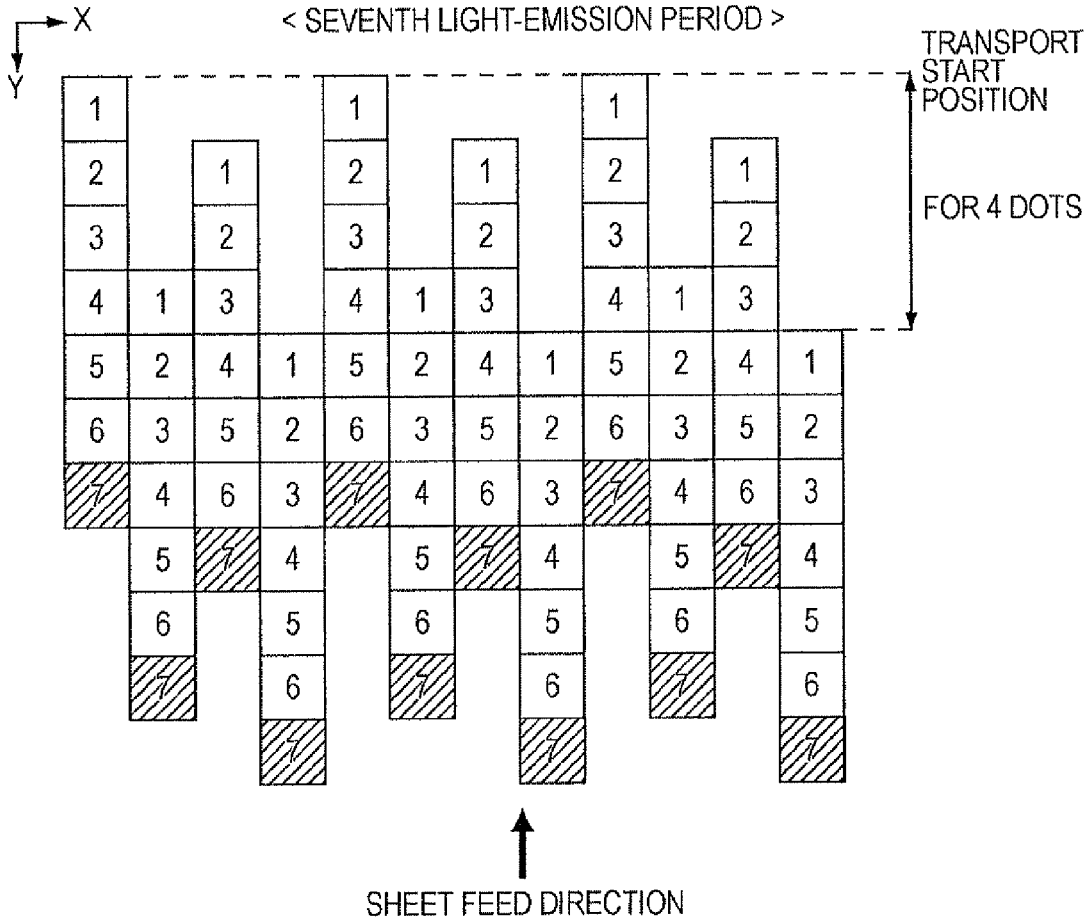
FIG. 7 is a conceptual view illustrating exposure by the light-emitting device according to the first embodiment of the invention.

During a first light-emission period, hatched regions (pixels) of FIG. 4 on the surface of the photosensitive drum 12 are exposed. During a second light-emission period, hatched regions of FIG. 5 are exposed. During a third light-emission period, hatched regions of FIG. 6 are exposed. Thereafter, the same light-emission operation is repeatedly conducted, and as shown in FIG. 7 (hatched regions of FIG. 7 represent regions to be exposed during a seventh light-emission period on the surface of the photosensitive drum 12), an image (latent image) having pixels arranged in a lattice is sequentially formed on the surface of the photosensitive drum 12 starting with a position away from a transport start position for 4 dots.

Second Embodiment

Figure 8:
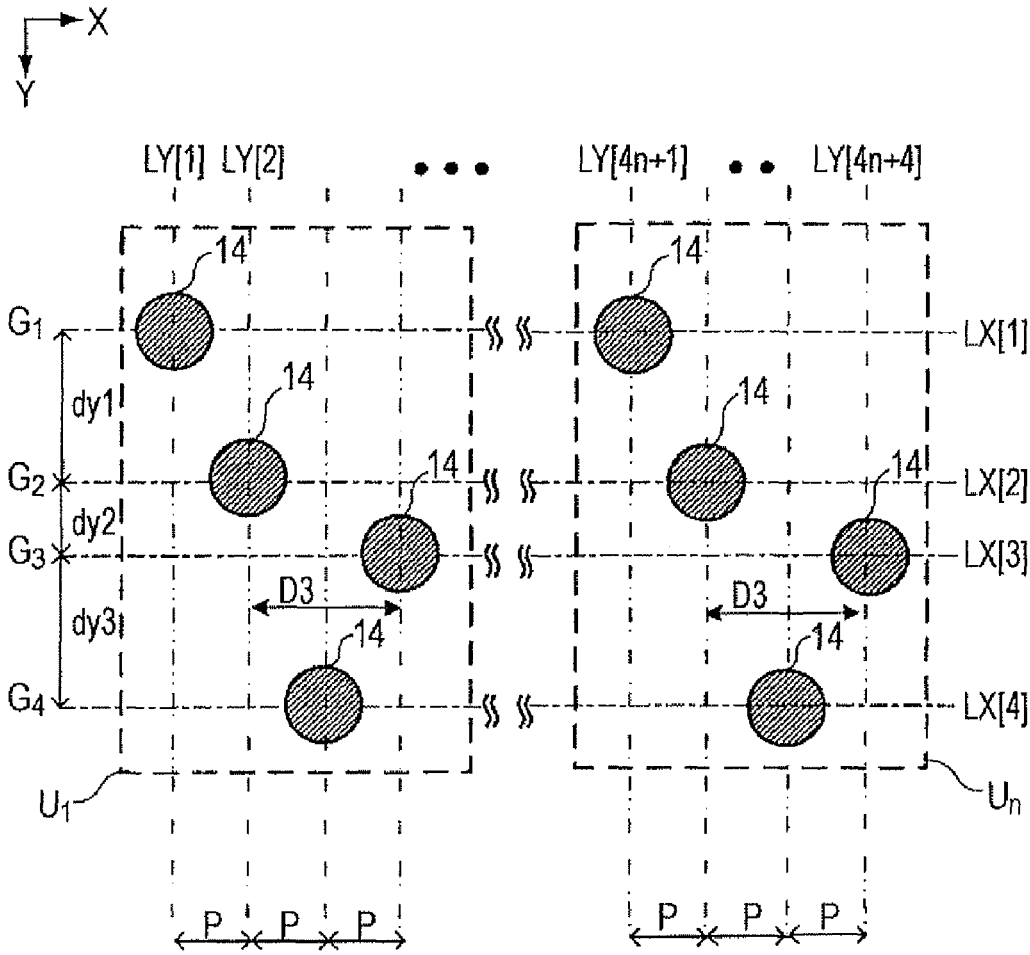
FIG. 8 is a plan view of a light-emitting device according to a second embodiment of the invention.

FIG. 8 is a plan view of a light-emitting device 10 according to a second embodiment of the invention. As shown in FIG. 8, the n light-emitting elements 14 belonging to an element group $G_1$ of a first row are individually disposed on (4*k*+1)th lines LY[4*k*+1] (where k=0, 1, 2, . . . , and n). The n light-emitting elements 14 belonging to an element group $G_2$ of a second row are individually disposed on (4*k*+2)th lines LY[4*k*+2]. The n light-emitting elements 14 belonging to an element group $G_3$ of a third row are individually disposed on (4*k*+4)th lines LY[4*k*+4]. The n light-emitting elements 14 belonging to an element group $G_4$ of a fourth row are individually disposed on (4*k*+3)th lines LY[4*k*+3].

That is, each of the light-emitting elements 14 belonging to the element group $G_4$ is disposed within a space between the line LY[4*k*+2] on which the center of each of the light-emitting elements 14 belonging to the element group $G_2$ is disposed and the line LY[4*k*+4] on which the center of each of the light-emitting elements 14 belonging to the element group $G_3$ is disposed. Therefore, laying focus on adjacent element groups $G_2$ and $G_3$ in the Y direction, a center-to-center distance D3 in the X direction between each of the light-emitting elements 14 belonging to the element group $G_2$ and a corresponding one of the light-emitting elements 14 belonging to the element group $G_3$ becomes a distance 2P (for two columns) larger than an interval P between the lines LY.

According to the configuration of this embodiment, in order to ensure an interval L between the center of each of the light-emitting elements 14 belonging to the element group $G_2$ of the second row and the center of a corresponding one of the light-emitting elements 14 belonging to the element group $G_3$ of the third row, what is necessary is that a distance dy2 between the line LX[2] (the element group $G_2$) and the line LX[3] (the element group $G_3$) is set to be larger than $\sqrt{(L^2-4P^2)}$. Therefore, it is possible to reduce the dimension of the element forming region in the Y direction, as compared with the comparative example.

Third Embodiment

Figure 9:
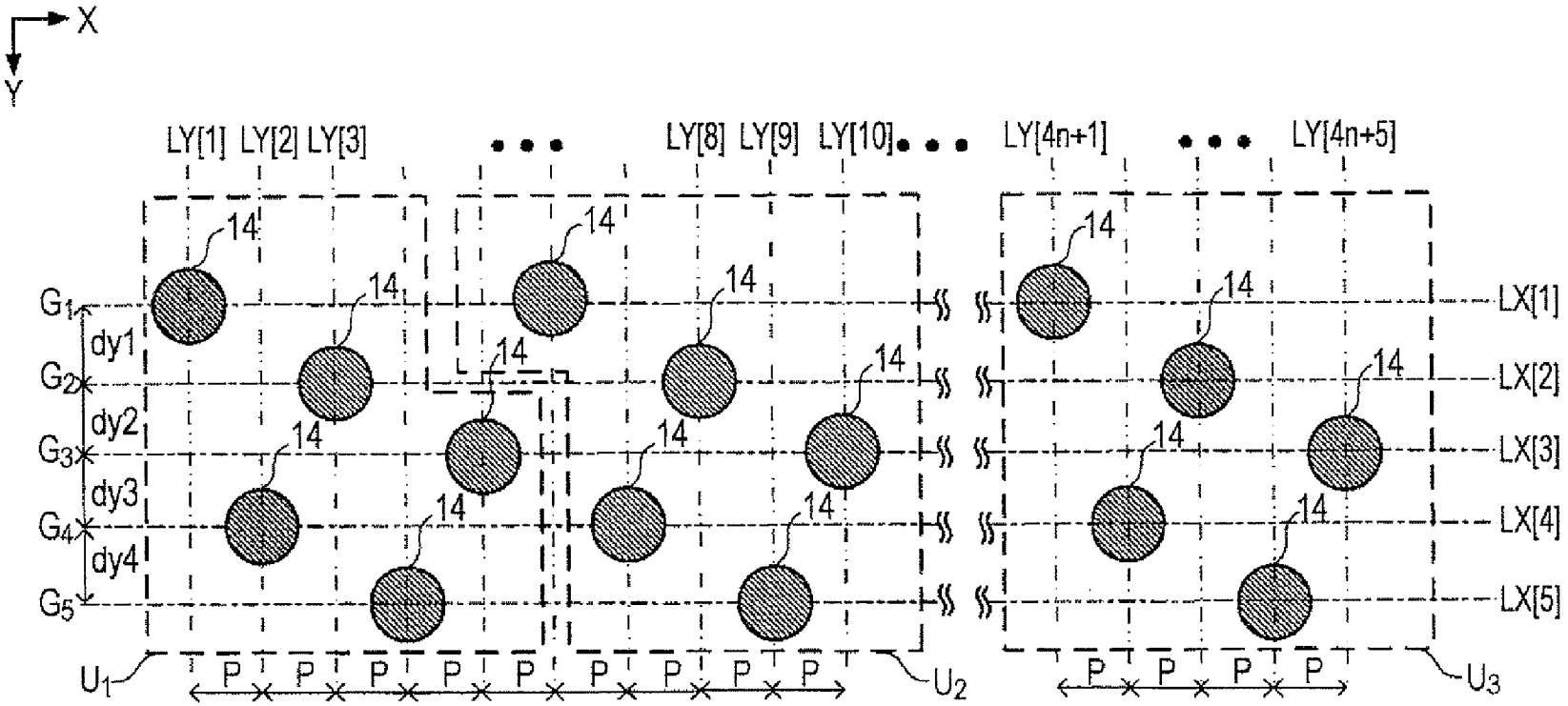
FIG. 9 is a plan view of a light-emitting device according to a third embodiment of the invention.

FIG. 9 is a plan view of a light-emitting device 10 according to a third embodiment of the invention. As shown in FIG.

9, five rows of element groups G ($G_1$ to $G_5$) are arranged on a surface of a substrate 13 in parallel in the Y direction. The n light-emitting elements 14 belonging to an element group $G_1$ of a first row are individually disposed on (4*k*+1)th (where k=0, 1, 2, . . . , and n) lines LY[4*k*+1]. The n light-emitting elements 14 belonging to an element group $G_2$ of a second row are individually disposed on (4*k*+3)th lines LY[4*k*+3]. The n light-emitting elements 14 belonging to an element group $G_3$ of a third row are individually disposed on (4*k*+5)th lines LY[4*k*+5]. The n light-emitting elements 14 belonging to an element group $G_4$ of a fourth row are individually disposed on (4*k*+2)th lines LY[4*k*+2]. The n light-emitting elements 14 belonging to an element group $G_5$ of a fifth row are individually disposed on (4*k*+4)th lines LY[4*k*+4]. Therefore, in respect to all combinations of adjacent element groups G in the Y direction, it is possible to set the center-to-center distance in the X direction between the light-emitting elements 14 to be larger than an interval P between the lines LY.

In respect to a set of element groups $G_2$ and $G_3$ and a set of element groups $G_4$ and $G_5$, the same relationship is established. Therefore, what is necessary is that the distances dy2 and dy4 in FIG. 9 is set to be larger than the $\sqrt{(L^2-4P^2)}$.

Similarly, the light-emitting elements 14 belonging to the element groups $G_2$ and $G_5$ are disposed within an interval between the line LY[4*k*+5] on which each of the light-emitting elements 14 belonging to the element group $G_3$ is disposed and the line LY[4*k*+2] on which each of the light-emitting elements 14 belonging to the element group $G_4$ is disposed. A center-to-center distance in the X direction between each of the light-emitting elements 14 belonging to the element group $G_3$ and a corresponding one of the light-emitting elements 14 belonging to the element group $G_4$ becomes a distance 3P (for three columns) larger than the interval P between the lines LY. In order to ensure the interval L between the center of each of the light-emitting elements 14 belonging to the element group $G_3$ of the third row and the center of a corresponding one of the light-emitting elements 14 belonging to the element group $G_4$ of the fourth row, what is necessary is that the distance dy2 between the line LX[3] (the element group $G_3$) and the line LX[4] (the element group $G_4$) is set to be larger than the $\sqrt{(L^2-9P^2)}$.

As described above, according to this embodiment, it is possible to reduce the dimension of the element forming region in the Y direction, as compared with the comparative example.

Modifications

The invention is not limited to the foregoing embodiments, but the following modifications can be made. Two or more of the following modifications may be combined.

(1) Modification 1

According to the configuration shown in FIG. 2, the light-emitting elements 14 belonging to the element group $G_1$ are individually disposed to be spaced by the interval P from the light-emitting elements 14 belonging to the element group $G_3$ on one side in the X direction. The light-emitting elements 14 belonging to the element group $G_2$ are individually disposed to be spaced by the interval P from the light-emitting elements 14 belonging to the element group $G_3$ on the other side in the X direction. The light-emitting elements 14 belonging to the element group $G_3$ are individually disposed to be spaced by the interval P from the light-emitting elements 14 belonging to the element group $G_2$ on one side in the X direction. The light-emitting elements 14 belonging to the element group $G_4$ are individually disposed to be spaced by the interval P from the light-emitting elements 14 belonging to the element group $G_2$ on the other side in the X direction.

According to the configuration shown in FIG. 8, the light-emitting elements 14 belonging to the element group $G_2$ are individually disposed to be spaced by the interval P from the light-emitting elements 14 belonging to the element group $G_4$ on one side in the X direction. The light-emitting elements 14 belonging to the element group $G_4$ are individually disposed to be spaced by the interval P from the light-emitting elements 14 belonging to the element group $G_4$ on the other side in the X direction.

According to the configuration shown in FIG. 9, the light-emitting elements 14 belonging to the element group $G_1$ are individually disposed to be spaced by the interval P from the light-emitting elements 14 belonging to the element group $G_4$ on one side in the X direction. The light-emitting elements 14 belonging to the element group $G_2$ are individually disposed to be spaced by the interval P from the light-emitting elements 14 belonging to the element group $G_4$ on the other side in the X direction. The light-emitting elements 14 belonging to the element group $G_2$ are individually disposed to be spaced by the interval P from the light-emitting elements 14 belonging to the element group $G_5$ on one side in the X direction. The light-emitting elements 14 belonging to the element group $G_3$ are individually disposed to be spaced by the interval P from the light-emitting elements 14 belonging to the element group $G_5$ on the other side in the X direction. The light-emitting elements 14 belonging to the element group $G_3$ are individually disposed to be spaced by the interval 2P from the light-emitting elements 14 belonging to the element group $G_2$ on the other side in the X direction. The light-emitting elements 14 belonging to the element group $G_4$ are individually disposed to be spaced by the interval P from the light-emitting elements 14 belonging to the element group $G_2$ on one side in the X direction. The light-emitting elements 14 belonging to the element group $G_4$ are individually disposed to be spaced by the interval P from the light-emitting elements 14 belonging to the element group $G_2$ on one side in the X direction. The light-emitting elements 14 belonging to the element group $G_5$ are individually disposed to be spaced by the interval P from the light-emitting elements 14 belonging to the element group $G_2$ on the other side in the X direction.

As will be seen from the foregoing illustrations, according to the invention, laying focus on a first element group, a second element group, and a third element group adjacent to the second element group from among four or more rows of element groups G, the arrangement of the light-emitting elements depends on the conditions: in each of a plurality of unit regions U ($U_1$ to $U_n$), the light-emitting element belonging to the second element group is disposed on one side in the X direction when viewed from the light-emitting element belonging to the first element group; and the light-emitting element belonging to the third element group is disposed on the other side in the X direction when viewed from the light-emitting element belonging to the first element group. The arrangement of the light-emitting elements 14 is not limited to the foregoing illustrations. The "first element group" includes the element groups $G_2$ and $G_3$ shown in FIG. 2, the element group $G_4$ shown in FIG. 8, and the element groups $G_2$, $G_4$, and $G_5$ shown in FIG. 9.

Specifically, in order to suppress an increase in dimension in the Y direction of a region where each light-emitting element 14 is to be formed, the distance in the X direction between the light-emitting elements 14 belonging to two rows of adjacent element groups G from among four or more rows of element groups G is set to be larger than the distance P (the interval P between the lines LY) in the X direction between adjacent light-emitting elements 14 in the X direction. Various modifications may be made without being limited to the foregoing embodiments. For example, although in the third embodiment, the center-to-center distance in the X direction between the light-emitting elements 14 of adjacent element groups G in the Y direction is set to be larger than the dimension P, only a center-to-center distance in the X direction between the light-emitting elements 14 belonging to the element groups $G_2$ and $G_3$ from among adjacent element groups G in the Y direction may be set to be larger than the dimension P.

(2) Modification 2

According to the first embodiment, the center-to-center distance dy (dy1 to dy3) in the Y direction between the light-emitting elements 14 belonging to adjacent element groups G in the Y direction is arbitrarily changed. For example, if it is not necessary to arrange the pixels of the image in a lattice, the distance dy (dy1 to dy3) in the Y direction between the light-emitting elements 14 may be an integer multiple of the dimension P.

(3) Modification 3

Each of the light-emitting elements 14 may be an OLED element, an inorganic light-emitting diode, or an LED (Light Emitting Diode). Any elements may be used as the light-emitting elements 14 according to the embodiments of the invention insofar as the elements emit light in accordance with electrical energy supply (electric field application or current supply).

Electronic Apparatus

An image forming apparatus as an example of an electronic apparatus according to the invention will now be described with reference to FIG. 10. The image forming apparatus is a tandem-type full color image forming apparatus which uses a belt intermediate transfer method.

The image forming apparatus includes four light-emitting devices 10K, 10C, 10M, and 10Y having the same configuration, which are individually disposed at positions opposed to the image forming surfaces 110 of four photosensitive drums (image bearing members) 110K, 110C, 110M, and 110Y having the same configuration. The light-emitting devices 10K, 10C, 10M, and 10Y have the same configuration as the light-emitting device 10 according to each of the foregoing embodiments.

Figure 10:
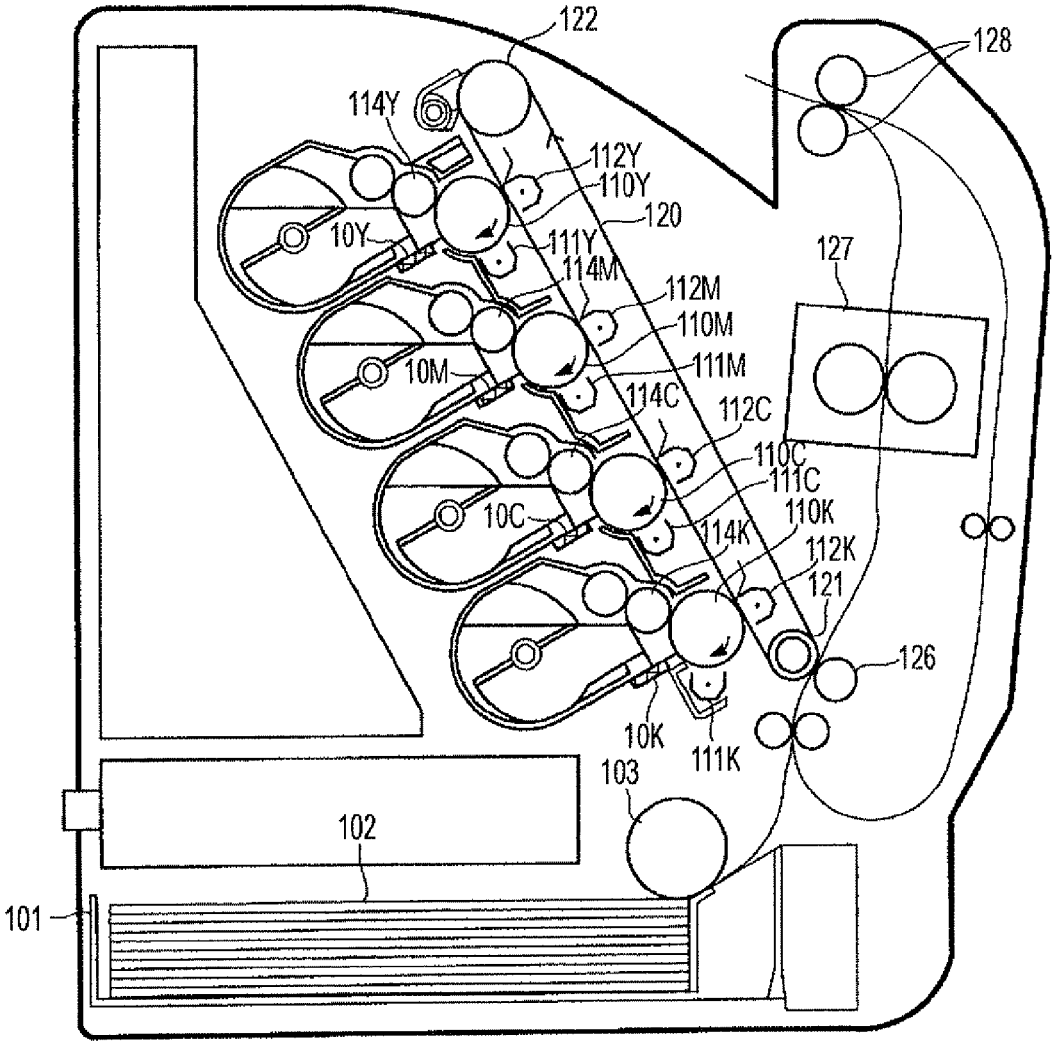
FIG. 10 is a perspective view showing a specific example (image forming apparatus) of an electronic apparatus according to an embodiment of the invention.

As shown in FIG. 10, the image forming apparatus is provided with a driving roller 121 and a driven roller 122. An endless intermediate transfer belt 120 is wound around the rollers 121 and 122, and turns around the rollers 121 and 122 as indicated by an arrow. Though not shown, a tension application member, such as a tension roller, may be provided to apply tension to the intermediate transfer belt 120.

The four photosensitive drums 110K, 110C, 110M, and 110Y each having a photosensitive layer on its outer peripheral surface are disposed at predetermined intervals around the intermediate transfer belt 120. The suffixes "K", "C", "M", and "Y" mean black, cyan, magenta, and yellow used for forming corresponding toner images, respectively. The same is applied to other members. The photosensitive drums 110K, 110C, 110M, and 110Y are driven to rotate in synchronization with the driving of the intermediate transfer belt 120.

A corona charger 111 (K, C, M, and Y), the light-emitting device 10 (K, C, M, and Y), and a developer 114 (K, C, M, and Y) are arranged around each photosensitive drum 110 (K, C, M, and Y). Each corona charger 111 (K, C, M, and Y) uniformly charges the image forming surface 110A (outer peripheral surface) of the corresponding photosensitive drum 110 (K, C, M, and Y). Each light-emitting device 10 (K, C, M, and Y) writes an electrostatic latent image on the charged image forming surface 110A of the photosensitive drum. In each light-emitting device 10 (K, C, M, and Y), a plurality of light-emitting elements 20 are arranged along the generatrix (main scanning direction) of the photosensitive drum 110 (K, C, M, and Y). The writing of the electrostatic latent image is performed by irradiating light emitted from the plurality of light-emitting elements 20 onto the photosensitive drum 110 (K, C, M, and Y). Each developer 114 (K, C, M, and Y) deposits toner serving as a developing agent on the electrostatic latent image to form a toner image (that is, a visible image) on the photosensitive drum 110 (K, C, M, and Y).

The black, cyan, magenta, and yellow toner images formed by the four monochromatic imaging systems are primarily transferred sequentially on the intermediate transfer belt 120 so as to be superposed on the intermediate transfer belt 120. As a result, a full color toner image is formed. Four primary transfer corotrons (transfer unit) 112 (K, C, M, and Y) are arranged inside the intermediate transfer belt 120. The primary transfer corotrons 112 (K, C, M, and Y) are individually arranged around the photosensitive drums 110 (K, C, M, and Y), and electrostatically attract the toner images from the photosensitive drums 110 (K, C, M, and Y) to transfer the toner images on the intermediate transfer belt 120 passing between the photosensitive drums and the primary transfer corotrons.

Sheets 102 serving as targets (recording mediums) on which images are to be finally formed are fed from a sheet feeding cassette 101 by a pickup roller 103 one by one, and are then sent to a nip between the intermediate transfer belt 120 in contact with the driving roller 121 and a secondary transfer roller 126. The full color toner images on the intermediate transfer belt 120 are secondarily transferred collectively to one side of the sheet 102 by the secondary transfer roller 126. The transferred toner image passes through a pair of fixing rollers 127 serving as a fixing unit to be then fixed on the sheet 102. Thereafter, the sheet 102 is discharged onto a sheet discharging cassette formed at the upper part of the image forming apparatus by a pair of sheet discharge rollers 128.

Figure 11:
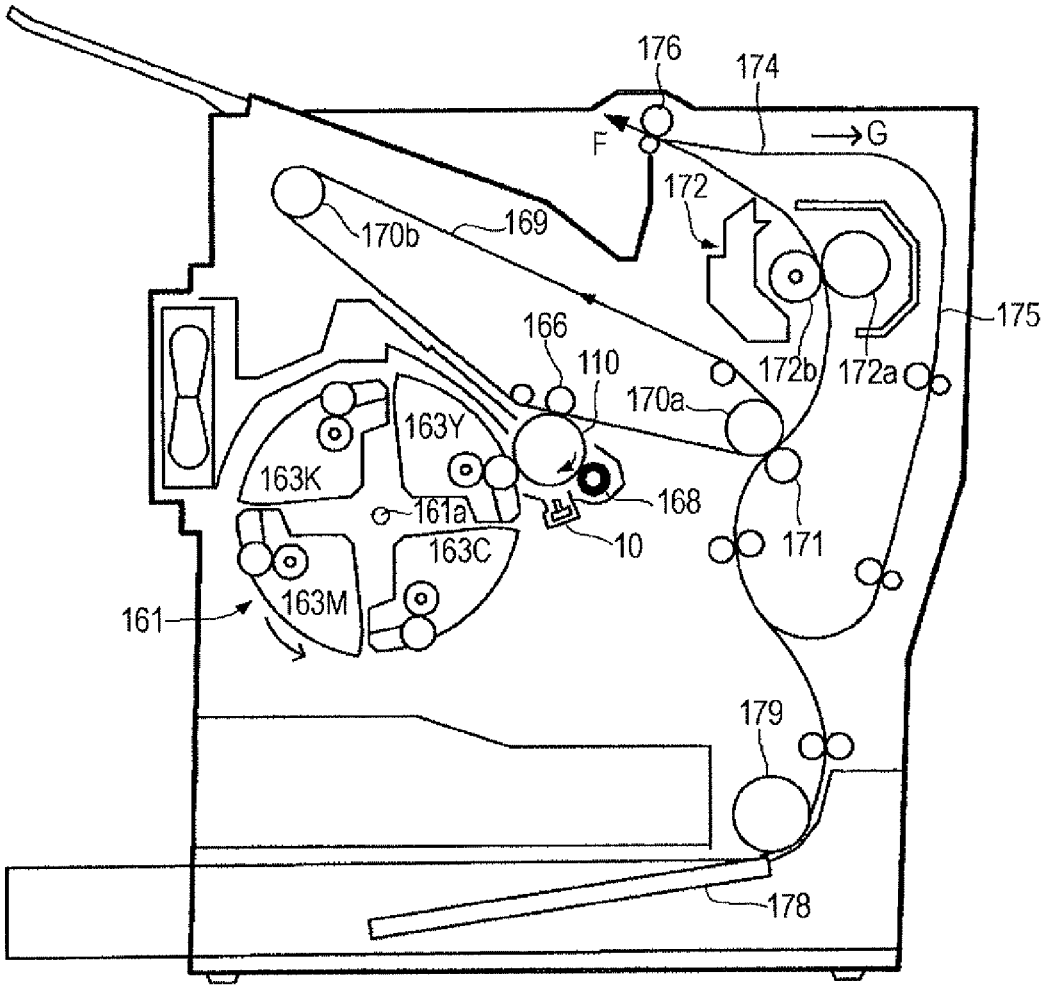
FIG. 11 is a perspective view showing a specific example (image forming apparatus) of an electronic apparatus according to an embodiment of the invention.

Next, another example of the image forming apparatus according to the invention will be described with reference to FIG. 11. The image forming apparatus is a rotary development-type full color image forming apparatus which uses a belt intermediate transfer method. As shown in FIG. 11, a corona charger 168, a rotary developing unit 161, the light-emitting device 10 according to each of the foregoing embodiments, and an intermediate transfer belt 169 are provided around a photosensitive drum 110.

The corona charger 168 uniformly charges the outer peripheral surface of the photosensitive drum 110. The light-emitting device 10 writes an electrostatic latent image on the charged image forming surface (outer peripheral surface) of the photosensitive drum 110. In the light-emitting device 10, a plurality of light-emitting elements 32 are arranged along the generatrix (main scanning direction) of the photosensitive drum 110. The writing of the electrostatic latent image is performed by irradiating light emitted from the light-emitting elements 32 onto the photosensitive drum 110.

The developing unit 161 is a drum having four developers 163Y, 163C, 163M, and 163K arranged at angular intervals of 90°, and is rotatable around a shaft 161*a* in a counterclockwise direction. The developers 163Y, 163C, 163M, and 163K individually supply toner of yellow, cyan, magenta, and black to the photosensitive drum 110, and deposits toner serving as a developing agent on the electrostatic latent image to form a toner image (that is, a visible image) on the photosensitive drum 110.

An endless intermediate transfer belt 169 is wound around a driving roller 170*a*, a driven roller 170*b*, a primary transfer roller 166, and a tension roller, and turns around these rollers in a direction indicated by an arrow. The primary transfer roller 166 electrostatically attracts the toner image from the photosensitive drum 110 to transfer the toner image to the intermediate transfer belt 169 passing between the photosensitive drum 110 and the primary transfer roller 166.

Specifically, during the first one turn of the photosensitive drum 110, an electrostatic latent image for a yellow (Y) image is written by the light-emitting device 10, and a toner image of the same color is formed by the developer 163Y and is then transferred to the intermediate transfer belt 169. During the next one turn, an electrostatic latent image for a cyan (C) image is written by the light-emitting device 10, and a toner image of the same color is formed by the developer 163C and is then transferred to the intermediate transfer belt 169 so as to be superposed on the yellow image. As the photosensitive drum 110 makes four turns in this way, the toner images of yellow, cyan, magenta, and black are sequentially superposed on the intermediate transfer belt 169. As a result, a full color toner image is formed on the transfer belt 169. When images are formed on both sides of a sheet serving as a target on which the images are to be finally formed, a full color toner image is formed on the intermediate transfer belt 169 in such a manner that toner images of the same color are transferred to the front and rear surfaces of the intermediate transfer belt 169, and then toner images of the next color are transferred to the front and rear surfaces of the intermediate transfer belt 169.

The image forming apparatus is provided with a sheet transport path 174 through which a sheet passes. Sheets are picked up one by one by a pickup roller 179 from a sheet feeding cassette 178, are transported by a transport roller along the sheet transport path 174, and passes through a nip between the intermediate transfer belt 169 in contact with the driving roller 170*a* and a secondary transfer roller 171. The secondary transfer roller 171 electrostatically attracts a full color toner image collectively from the intermediate transfer belt 169 to transfer the toner image on one side of the sheet. The secondary transfer roller 171 is configured to approach and be separated from the intermediate transfer belt 169 by a clutch (not shown). When a full color toner image is transferred to a sheet, the secondary transfer roller 171 is brought into contact with the intermediate transfer belt 169. When toner images are superposed on the intermediate transfer belt 169, the secondary transfer roller 171 is separated from the intermediate transfer belt 169.

The sheet having the toner image transferred thereto in this way is transported to a fixing unit 172 and then passes between a heating roller 172*a* and a pressing roller 172*b* of the fixing unit 172, such that the toner image is fixed on the sheet. The sheet after the fixation process passes between a pair of sheet discharge rollers 176 to be transported in a direction indicated by an arrow F. In case of double-sided printing, after most of the sheet passes between the pair of sheet discharge rollers 176, the pair of sheet discharge rollers 176 are rotated in a reverse direction, such that the sheet is introduced into a transport path 175 for double-sided printing, as indicated by an arrow G. Then, the toner image is transferred to the other side of the sheet by the secondary transfer roller 171, and the fixing unit 172 performs the fixation process on the toner image again. Thereafter, the sheet is discharged by the pair of sheet discharge rollers 176.

The image forming apparatus shown in FIG. 10 or 11 uses a light source (exposure device) in which an OLED element is used as the light-emitting element 20. Therefore, the image forming apparatus is reduced in size, as compared with a case in which a laser scanning optical system is used. Moreover, the light-emitting device 10 according to each of the embodiments of the invention may be used in other electrophotographic image forming apparatuses. For example, the light-emitting device 10 according to each of the embodiments of the invention may be used in an image forming apparatus that directly transfers a toner image to a sheet from a photosensitive drum without using an intermediate transfer belt, or an image forming apparatus that forms a monochromatic image.

The light-emitting device according to each of the embodiments of the invention is not limited to the exposure of the photosensitive member, but it may be used for various purposes. For example, the light-emitting device according to each of the embodiments of the invention may be used in an image reading apparatus, such as a scanner, as a linear optical head (illumination device), which irradiates light onto a target to be read, such as an original document. An image reading apparatus of this type includes a scanner, a reading part of a copy machine or a facsimile machine, a barcode reader, or a two-dimensional image code reader that reads a two-dimensional image code, such as QR Code (Registered Trademark). A light-emitting device having a plurality of light-emitting elements (in particular, light-emitting elements) planarly arranged may be used as a backlight unit provided on the rear side of a liquid crystal panel. A light-emitting device having a plurality of light-emitting elements arranged in a matrix may be used as a display device for various electronic apparatuses.

The entire disclosure of Japanese Application No. 2007-310003, filed Nov. 30, 2007 is expressly incorporated by reference herein.

What is claimed is:

1. A light-emitting device comprising:

four or more rows of element groups each having light-emitting elements arranged in a first direction, the element groups being arranged in parallel in a second direction different from the first direction, wherein in each of a plurality of unit regions arranged in the first direction, the light-emitting elements belonging to the four or more rows of element groups are individually arranged at different positions in the first direction, the four or more rows of element groups include a first element group, a second element group, and a third element group adjacent to the second element group, each element group includes only one light-emitting element within each of the plurality of unit regions, in each of the plurality of unit regions, the light-emitting element belonging to the second element group is disposed on one side in the first direction when viewed from the light-emitting element belonging to the first element group, and the light-emitting element belonging to the third element group is disposed on the other side in the first direction when viewed from the light-emitting element belonging to the first element group, the one side is a position in the first direction that is before or after the light-emitting element belonging to the first element group, and the other side is a position in the first direction that is opposite to the one side relative to the light-emitting element belonging to the first element group, and with respect to the second direction, the second light-emitting element is disposed between the first light-emitting element and the third light-emitting element.

2. The light-emitting device according to claim 1, wherein the light-emitting elements are individually disposed on lines that are arranged in parallel at regular intervals along the first direction and extend in the second direction.

3. The light-emitting device according to claim 2, wherein the four or more rows of element groups include four rows of element groups, the light-emitting elements belonging to an element group of a first row are individually disposed on (4*k*+1)th lines (where k=0, 1, . . . , and n), the light-emitting elements belonging to an element group of a second row are individually disposed on (4*k*+3)th lines, the light-emitting elements belonging to an element group of a third row are individually disposed on (4*k*+2)th lines, and the light-emitting elements belonging to an element group of a fourth row are individually disposed on (4*k*+4)th lines.

4. The light-emitting device according to claim 3, wherein a distance in the second direction between each of the light-emitting elements belonging to the element group of the first row and a corresponding one of the light-emitting elements belonging to the element group of the second row, and a distance in the second direction between each of the light-emitting elements belonging to the element group of the third row and a corresponding one of the light-emitting elements belonging to the element group of the fourth row are shorter than a distance in the second direction between each of the light-emitting elements belonging to the element group of the second row and a corresponding one of the light-emitting elements belonging to the element group of the third row.

5. The light-emitting device according to claim 2, wherein the four or more rows of element groups include four rows of element groups, the light-emitting elements belonging to an element group of a first row are individually disposed on (4*k*+1)th lines (where k=0, 1, . . . , and n), the light-emitting elements belonging to an element group of a second row are individually disposed on (4*k*+2)th lines, the light-emitting elements belonging to an element group of a third row are individually disposed on (4*k*+4)th lines, and the light-emitting elements belonging to an element group of a fourth row are individually disposed on (4*k*+3)th lines.

6. The light-emitting device according to claim 5, wherein a distance in the second direction between each of the light-emitting elements belonging to the element group of the second row and a corresponding one of the light-emitting elements belonging to the element group of the third row is shorter than a distance in the second direction between each of the light-emitting elements belonging to the element group of the first row and a corresponding one of the light-emitting elements belonging to the element group of the second row, and a distance in the second direction between each of the light-emitting elements belonging to the element group of the third row and a corresponding one of the light-emitting elements belonging to the element group of the fourth row.

7. The light-emitting device according to claim 2, wherein the four or more rows of element groups include five rows of element groups, the light-emitting elements belonging to an element group of a first row are individually disposed on (4*k*+1)th lines (where k=0, 1, . . . , and n), the light-emitting elements of an element group of a second row are individually disposed on (4*k*+3)th lines, the light-emitting elements belonging to an element group of a third row are individually disposed on (4*k*+5)th lines, the light-emitting elements belonging to an element group of a fourth row are individually disposed on (4*k*+2)th lines, and the light-emitting elements belonging to an element group of a fifth row are individually disposed on (4*k*+4)th lines.

8. A light-emitting device comprising:

a plurality of light-emitting elements that are arranged in parallel in a first direction and a second direction intersecting the first direction, wherein the plurality of light-emitting elements are formed by a plurality of element groups provided with respect to the second direction and a plurality of unit regions provided with respect to the first direction, each of the plurality of unit regions includes a first light-emitting element, a second light-emitting element, a third light-emitting element, and a fourth light-emitting element, each of the plurality of element groups includes only one light-emitting element within each of the plurality of unit regions, with respect to the second direction, the second light-emitting element is disposed between the first light-emitting element and the third light-emitting element, and with respect to the first direction, the third light-emitting element is disposed between the first light-emitting element and the second light-emitting element.

9. The light-emitting device according to claim 8, wherein with respect to the second direction, the first light-emitting element, the second light-emitting element, the third light-emitting element, and the fourth light-emitting element are arranged in that order, and with respect to the first direction, the first light-emitting element, the third light-emitting element, the second light-emitting element, and the fourth light-emitting element are arranged in that order.

10. The light-emitting device according to claim 8, wherein each of the plurality of unit regions further includes a fifth light-emitting element, with respect to the second direction, the first light-emitting element, the second light-emitting element, the third light-emitting element, the fourth light-emitting element, and the fifth light-emitting element are arranged in that order, and with respect to the first direction, the first light-emitting element, the third light-emitting element, the fifth light-emitting element, the second light-emitting element, and the fourth light-emitting element are arranged in that order.

11. An electronic apparatus comprising the light-emitting device according to claim 1.

* * * * *